United States Patent [19]

Van Ingen Schenau

[11] Patent Number: 4,934,526

[45] Date of Patent: Jun. 19, 1990

[54] BAG-SHAPED CONTAINER

[75] Inventor: Hendricus C. Van Ingen Schenau, Venhuizen, Netherlands

[73] Assignee: Royal Sluis Koninklijke Zaaizaadbedrijven Gebroeders Sluis B.V., Netherlands

[21] Appl. No.: 343,864

[22] Filed: Apr. 26, 1989

[30] Foreign Application Priority Data

Apr. 26, 1988 [NL] Netherlands ..... 8801080

[51] Int. Cl.[5] ..... B65D 69/00

[52] U.S. Cl. ..... 206/223; 206/459; 206/820

[58] Field of Search ..... 206/820, 223, 459

[56] References Cited

U.S. PATENT DOCUMENTS

| | | | |
|---|---|---|---|
| 2,877,893 | 3/1959 | Volckening et al. | 206/820 |
| 3,047,139 | 7/1962 | Jacoff | 206/820 |
| 3,162,539 | 12/1964 | Redko | 206/820 |
| 3,254,823 | 6/1966 | Lerner | 206/820 |
| 3,286,831 | 11/1966 | Giberstein | 206/820 |
| 3,333,688 | 8/1967 | Green, Jr. | 206/820 |
| 4,433,783 | 2/1984 | Dickinson | 206/77.1 |
| 4,488,642 | 12/1984 | Changani et al. | 206/820 |
| 4,570,797 | 1/1986 | Weinman | 206/820 |

*Primary Examiner*—Joseph Man-Fu Moy
*Attorney, Agent, or Firm*—Lorusso & Loud

[57] ABSTRACT

The invention relates to a bag-shaped container with a receiving capacity for receiving seeds or the like and with a releasable marker section. Preferably the marker section can be released from the remaining part of the container without additional tools, for example by a perforation.

10 Claims, 1 Drawing Sheet

BAG-SHAPED CONTAINER

Figure 1:
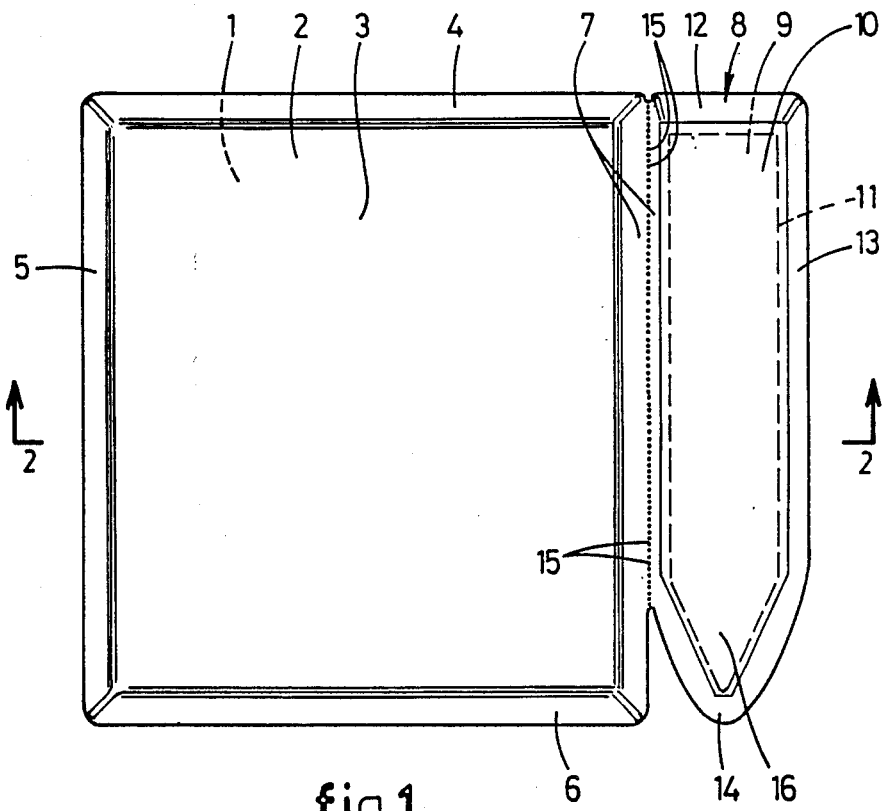

The invention relates to a bag-shaped container with a receiving capacity for receiving seeds or the like.

Known containers for receiving seeds mostly are provided with an external indication of the contents of the container. After such a container has been opened and the seeds are brought into the soil this indication on the container however can no longer be used. For indicating the kind of seed that has been planted additional marker plates, strips or the like are used.

It is an object of the invention to provide a bag-shaped container of the type mentioned before that, after the seeds have been removed from the receiving capacity, can be used too.

For this purpose the bag-shaped container according to the invention is characterized in that it comprises a releasable stiff marker section that adjoins the receiving capacity without being part thereof.

After the seeds have been transferred from the container into the soil the marker section can be released from the remaining section of the container and be pushed into the soil near the planted seeds. On the marker section the kind of seeds are indicated.

According to a preferred embodiment of the container according to the invention the receiving capacity and the marker section are separated by a seal joint or an adhesive joint. This seal joint or adhesive joint can be manufactured simply during the fabrication of the container. Because the marker section and the receiving capacity are separated from each other it is avoided that seeds, remaining in the receiving capacity, can fall out or can be put into the soil together with the marker section unintentionally.

Further it is advantageous if according to a preferred embodiment of the bag-shaped container according to the invention in the seal joint or adhesive joint weakenings, such as perforations, are provided having a smaller width than these joints. Like this the marker section can be torn free simply from the remaining part of the container without the need for additional tools.

If the marker section basically comprises two interconnected wall portions that each form an integral continuation of a corresponding wall portions of the receiving capacity, the manufacturing of the bag-shaped container according to the invention is extremely simple. During a conventional manufacturing process of a bag-shaped container, whereby the circumferential walls are sealed, the marker section can be formed by providing an additional seal joint.

According to a handy embodiment of the container according to the invention the wall portions of the marker section enclose a strip-like reinforcement-part. By application of this reinforcement part the marker section obtains a large stiffness such that providing it in the soil does not render any problems. Moreover an embodiment is possible in which the reinforcement part and the wall portions are shaped integrally. Providing the strip-like reinforcement part between both wall portions of the marker section already can be carried out before providing the seal joins during the manufacturing of the container. Moreover it is possible that the marker section, after shaping the receiving capacity, is attached to the remaining container section.

For simplifying the application of the marker section into the soil it is preferred that the reinforcement part at its one end ends in a point. Hereby it is possible that the wall portions of the marker section at the respective locations have a corresponding shape.

Hereafter the invention will be elucidated by means of the drawing in which an embodiment of the container according to the invention is illustrated.

Figure 2:
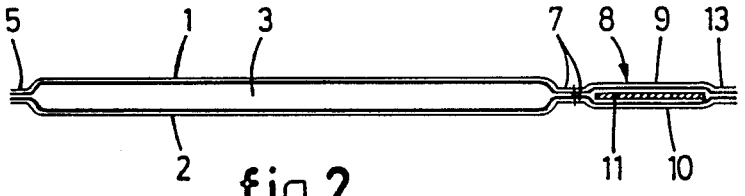

FIG. 1 shows a frontal view of an embodiment of the container according to the invention, and FIG. 2 shows a section according to II—II in FIG. 1.

The bag-shaped container shown in FIGS. 1 and 2 comprises a receiving capacity 3 limited by two wall portions 1 and 2 for receiving seed or the like. For defining the receiving capacity 3 the wall portions 1 and 2 are interconnected at their edges by joints, such as adhesive joints or seal joints 4 until 7.

The container is provided with a marker section 8 that at the joint 7 adjoins the receiving capacity 3. As appears clearly from FIG. 2 this marker section 8 basically comprises two interconnected wall portions 9 and 10 that each form an integral continuation of the corresponding wall portions 1 and 2 of the receiving capacity 3.

While enclosing a strip-like reinforcement part 11 the wall portions 9 and 10 are at their circumferential edges interconnected by the joint 7 and the joints 12 until 14. It is also possible however that the reinforcement part is as big as the marker section such that their side edges substantially coincide.

As appears clearly the joint 7 constitutes the division between the section of the container comprising the receiving capacity 3 and the marker section 8. For simplifying the removal of the marker section 8 from the remaining part of the container perforations 15 are provided in the joint 7. The width of these perforations 15 is less than the width of the joint 7 such that the receiving capacity 3 remains closed notwithstanding the perforations 15.

Instead of the application of perforations 15 it is of course possible too, that different methods known per se are applied for releasing the marker section 8 from the remaining part of the container. It is also possible, that the marker section 8 has to be cut loose from the remaining part.

FIG. 2 illustrates clearly that the reinforcement part 11 is shaped strip-like. Appropriate materials for the reinforcement part are among others metal, wood or plastic material.

At its lower end the reinforcement part 11 comprises a sharp point 16 such that the marker section 8, after being released from the remaining part of the container, can be pushed easily into the soil or the like. As appears clearly from FIG. 1 the wall portions 9 and 10 comprise near to the sharp point 16 of the reinforcement part 11 a corresponding tapering shape. However this is not necessary.

The invention is not limited to the embodiment described before but can be varied widely within the scope of the invention.

I claim:

1. An assembly for containing seeds and for releasably supporting a marker to be inserted into soil to identify the type of seed that was in the container when the seed is in the soil comprising:

(a) a bag-shaped container formed of two wall portions sealed at their edges and having seeds therein; and (b) a rigid marker releasably joined to one of said sealed edges in such a way that the marker can be removed from the bag-shaped container without damaging the seal on the bag-shaped container so that the seeds remain in the bag-shaped container, said rigid marker having a legend thereon which defines the type of seed in the bag-shaped container and which is designed to be inserted into the soil and identify the seeds in the bag-shaped container.

2. The assembly according to claim 1 wherein the bag-shaped container and marker are separated by a seal joint.

3. The assembly according to claim 1 wherein the bag-shaped container and marker are separated by an adhesive joint.

4. The assembly according to claim 2 wherein weakenings, such a perforations, are provided in the seal joint with such perforations having a smaller width than the seal joint.

5. The assembly according to claim 3 wherein weakenings, such as perforations, are provided in the adhesive joint, with such perforations having a smaller width than the adhesive joint.

6. The assembly according to claim 1 wherein the marker is comprised of two interconnected wall portions that each form an integral continuation of the corresponding wall portions of the bag-shaped container.

7. The assembly according to claim 6 wherein the wall portions of the marker enclose a strip-like reinforcement part.

8. The assembly according to claim 7 wherein the reinforcement part ends in a point at one end.

9. The assembly according to claim 7 wherein the reinforcement part is fabricated from metal, wood or plastic material.

10. The assembly according to claim 8 wherein the reinforcement part and the wall portions are shaped integrally.

* * * * *